United States Patent [19]

Kramming

[11] Patent Number: 4,583,349

[45] Date of Patent: Apr. 22, 1986

[54] METHOD OF STORING HANDLE BAGS

[75] Inventor: Erik Kramming, Saltsjöbaden, Sweden

[73] Assignee: Bengt Lundin AB, Arvika, Sweden

[21] Appl. No.: 126,283

[22] Filed: Mar. 3, 1980

Related U.S. Application Data

[60] Continuation of Ser. No. 27,847, Apr. 6, 1979, abandoned, which is a continuation of Ser. No. 586,693, Jun. 13, 1975, abandoned, which is a division of Ser. No. 415,854, Nov. 14, 1973.

[51] Int. Cl.[4] ..... B65B 43/26

[52] U.S. Cl. ..... 53/459; 53/390

[58] Field of Search ..... 53/384, 390, 459, 572; 248/100; 206/493, 806; 211/54, 59; 229/54 R

[56] References Cited

U.S. PATENT DOCUMENTS

| | | | |
|---|---|---|---|
| 2,790,591 | 4/1957 | Rosen | 53/384 X |
| 2,843,988 | 7/1958 | Thompson | 53/572 |
| 3,100,569 | 8/1963 | White | 206/493 |
| 3,385,428 | 5/1968 | Kugler | 206/493 |
| 3,715,854 | 2/1973 | Smith et al. | 53/572 X |
| 3,747,298 | 7/1973 | Lieberman | 53/390 |
| 3,869,065 | 3/1975 | Wang | 53/384 X |

*Primary Examiner*—John Sipos

*Attorney, Agent, or Firm*—Fred Philpitt

[57] ABSTRACT

A method for supporting a bundle of two-handle bags so as to better insure that only one bag at a time will be removed.

3 Claims, 2 Drawing Figures

METHOD OF STORING HANDLE BAGS

This is a continuation of application Ser. No. 027,847, filed Apr. 6, 1979 now abandoned and which is a continuation of Ser. No. 586,693, June 13, 1975, now abandoned which is a division of Ser. No. 415,854, Nov. 14, 1973.

In bags with handle openings, and particularly with plastic bags, it has long been a problem to take from a bundle of bags only one bag at a time and to open the bag. It is not possible, either, to simply stack plastic bags, because the bags will slide or flow after a certain time, unless the stack or bundle is held together. This problem is specially evident at cash registers in self-service shops where the customers are expected to take one bag at a time from a stock and to fill the bag with articles. It was found that the customers in many cases take more bags than necessary and thereby cause economic waste.

The present invention has as its object to eliminate the aforesaid problems and, in addition, provide the possibility of easier filling the bags with articles.

Figure 1:
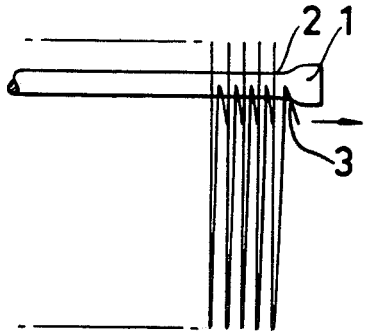
Figure 2:
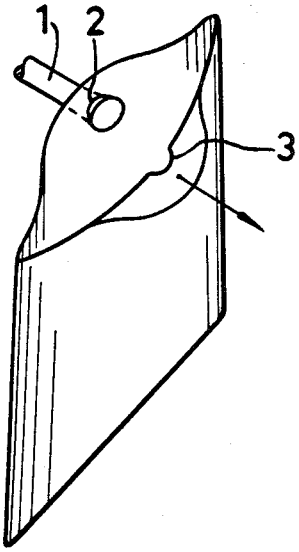

The invention is described in greater detail hereinafter, with reference to the accompanying drawing, in which FIG. 1 shows a side view of the invention with the bags disposed on an elongated support member, and FIG. 2 shows a perspective view of a bag which has been moved to the end of its elongated supporting member and is in a partially opened condition.

According to FIG. 1, the bags comprise front and rear flaps or handles with each handle having handle openings. The bags are suspended on a rod 1 in such a manner that the first of the two handle openings 2 in the rear flap is fitted over the rod. The second of two handle opening 3 in the front flap is folded down so as to be located below the rod 1. Said rod 1 has a dimension, which substantially corresponds to the size of the handle opening, and at the end of the rod 1 a thickening may be provided so that when the bag is drawn off there is some resistance from the rod 1.

The bags, thus, are in bundles fitted on the rod 1, with the second of the two handles being folded downwards along a fold line in the plane of the second opening 3 and intersecting the second opening so that the second openings 3 only partially surround the support rod. The folded down second opening faces in the direction, in which the bags are drawn off from the rod 1. Due to the fact that the handle opening 3 is folded down, it is easy to seize said handle opening with one hand and draw off the bag from the rod. There is no risk of subsequent bags following along therewith, and the bags can thus be taken from the rod 1 one at a time. When a suitable inertia or friction engagement exists between the rod 1 and the first handle opening 2, the bag will open itself whilst it is being drawn off the supporting rod and thereby will render it possible to place articles into the open bag. This is facilitated as the bag is seized only with one hand, and the other hand is free for placing articles into the bag.

In the embodiment shown, the bags are arranged freely suspended from a horizontal rod 1, but variations are imaginable and suitable. The rod 1 may be arranged inclined, and lateral supports for the bags may be provided to prevent the bags from swinging forth and back on the rod 1. Furthermore, a bottom support for the bag may be provided in the form of a plate or the like, which plate may extend past the end of rod 1 and constitute a plane for placing the bag thereon after it has been filled or for filling it with articles.

The drawings also show a special embodiment of the bag in which the handle openings are disposed above the bag edges. This is not necessary, but the only necessary requirement is that one handle opening can be folded down. A great number of variations of such bags exist. A possible variation is that the bag is a conventional paper bag with two handles arranged at the upper edge of the bag. Also such a bag can suitable be used for realizing the invention. The rod 1, furthermore, in the embodiment shown is round, but several other shapes may be used. It is essential, however, that a certain agreement exists between the cross-sectional shape of the rod 1 and the handle openings, in order to achieve all of the aforementioned advantages of the invention. It should be emphasized, however, that the rod, for example, may have the form of a board placed on edge and having a longest dimension in the cross-sectional shape which coincides with the dimension of the handle opening in the corresponding direction.

What I claim is:

1. A method of supporting, dispensing and packing a bundle of bags one at a time, each of said bags having a first handle opening located on one side of the bag and a second handle opening located on the opposite side of the bag, aligning the first handle opening of each bag with the first handle opening of every other bag in the bundle, the second handle opening of each bag being arranged out of complete alignment with said aligned first handle openings, supporting said bundle of bags by a supporting member, providing said supporting member with means to inhibit but not prohibit the removal of at least each first handle opening therefrom, and arranging the second handle opening of each bag closer to the discharge end of the supporting member than the first handle opening of said same bag, whereby the first bag of said bundle can be opened by grasping said second handle opening and said bag can be filled with the objects to be packed in the bag, said second handle opening only partially surrounding said supporting member.

2. The method of claim 1 wherein said second handle opening is folded over.

3. The method which comprises:

arranging a plurality of plastic bags in a front-to-back relationship so that they constitute a bundle of bags, each of said plastic bags having a front flap with front handle opening on one side of the bag and a rear flap with rear handle opening on the opposite side of the bag, all of said rear handle openings being aligned with each other in the bundle, each of said front flaps being folded along a line which is in the plane of the front opening and intersecting the front opening and all of said front handle openings being aligned with each other, passing an elongated supporting member through said aligned rear and front handle openings in a supporting relationship with said bundle of bags, so that said rear openings completely and said front openings only partially surround said supporting member and so that the front handle opening of each bag is closer to the discharge end of the supporting member than the back handle opening of that bag, moving the front flap with the handle opening of the first bag past the discharge end of said elongated supporting member and then exerting a manual force in a direction parallel to the axis of the elongated supporting member and continuing that force until a flap with the handle opening of that bag is inhibited against further outward movement by the restraining action of the discharge end of the elongated supporting member to thereby open up the interior of the bag so that the desired number of items can be deposited therein, completely removing the first plastic bag from said elongated supporting member after it has been filled with the desired number of items by manually manipulating the rear flap with the rear handle opening of that bag so that it overcomes the restraining action of the discharge end of said elongated supporting member without tearing the circumference of the rear handle opening, and repeating the above sequence of steps with the second and subsequent bags until all of the plastic bags in said bundle of bags have been filled with the desired items and have been removed.

* * * * *